US009653841B1

(12) United States Patent
Ye et al.

(10) Patent No.: US 9,653,841 B1
(45) Date of Patent: May 16, 2017

(54) WATERPROOF CONNECTOR

(71) Applicant: Cheng Uei Precision Industry Co., Ltd., New Taipei (TW)

(72) Inventors: Chao-Yong Ye, Dong-Guan (CN); Kai-Hsiang Chang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/246,429

(22) Filed: Aug. 24, 2016

(51) Int. Cl.

| | |
|---|---|
| ***H01R 13/627*** | (2006.01) |
| ***H01R 13/52*** | (2006.01) |
| ***H01R 13/405*** | (2006.01) |
| ***H01R 24/62*** | (2011.01) |
| *H01R 107/00* | (2006.01) |

(52) U.S. Cl.
CPC ..... *H01R 13/521* (2013.01); *H01R 13/405* (2013.01); *H01R 13/6275* (2013.01); *H01R 24/62* (2013.01); *H01R 2107/00* (2013.01)

(58) Field of Classification Search
CPC .... H01R 13/521; H01R 13/405; H01R 24/62; H01R 2107/00; H01R 13/639; H01R 13/6461; H01R 13/6275; H01R 24/60
USPC ..... 439/357
See application file for complete search history.

(56) References Cited

U.S. PATENT DOCUMENTS

| | | | | |
|---|---|---|---|---|
| 9,450,337 | B2 * | 9/2016 | Kao | H01R 13/6461 |
| 9,478,923 | B2 * | 10/2016 | Kao | H01R 24/60 |
| 2014/0057479 | A1 * | 2/2014 | Weber | H01R 13/639 439/357 |
| 2014/0349507 | A1 * | 11/2014 | Zhong | H01R 13/64 439/347 |

* cited by examiner

*Primary Examiner* — Jean F Duverne
(74) *Attorney, Agent, or Firm* — Cheng-Ju Chiang

(57) ABSTRACT

A waterproof connector includes an insulating housing, a terminal assembly, a cover, a clamping part and a filler. The insulating housing has an inserting chamber, a mounting slot, a plurality of terminal grooves, an installing slot and a pair of clamping slots. The terminal assembly includes a plurality of terminals and a mounting lump molded outside the terminals. The mounting lump is mounted in the mounting slot of the insulating housing. The terminals are mounted in the terminal grooves of the insulating housing. The cover attaches on the bottom face of the insulating housing and the mounting lump. The clamping part is fixed in the installing slot of the insulating housing and tails of the clamping part project inward into the inserting chamber of the insulating housing. The filler is integratedly filled in the installing slot of the insulating housing. The waterproof connector greatly improves the waterproof effect.

4 Claims, 6 Drawing Sheets

WATERPROOF CONNECTOR

BACKGROUND OF THE INVENTION

1. Field of the Invention

The present invention relates to a connector, and more particularly to a waterproof connector.

2. The Related Art

A traditional waterproof connector includes an insulating housing, a plurality of terminals, a shielding shell and an insulating shell. The terminals are mounted on the insulating housing. The shielding shell is worn outside the insulating housing. And the insulating shell is molded outside the insulating housing and the shielding shell.

However, the water is easily into the interior of the waterproof connector from the gaps of the insulating housing, the shielding shell and the insulating shell by the pressure of the water. So inventors need to provide a high grade of water-proof connector to resolve the defect of the traditional water-proof connector.

SUMMARY OF THE INVENTION

An object of the present invention is to provide a waterproof connector. The waterproof connector includes an insulating housing, a terminal assembly, a cover, a clamping part and a filler. A center of a front face of the insulating housing is concaved rearward to form an inserting chamber. A rear of a bottom face of the insulating housing is concaved upward to form a mounting slot. The bottom face of the insulating housing has a plurality of terminal grooves in front of and connecting with the mounting slot. A rear face of the insulating housing is concaved frontward to form an installing slot. Two sides of the installing slot are further concaved frontward to form a pair of clamping slots connecting with the inserting chamber. The terminal assembly includes a plurality of terminals and a mounting lump. The terminals are arranged in transverse direction. The mounting lump is molded outside middles of the terminals. The mounting lump of the terminal assembly is mounted in the mounting slot of the insulating housing. Fronts of the terminals are received in the terminal grooves and further projected into the inserting chamber. Rears of the terminals are exposed at the bottom face of the insulating housing. The cover attaches on the bottom face of the insulating housing and the mounting lump. The clamping part includes a clamping terminal and a pair of positioning lumps. The clamping terminal includes a fastening portion extending in transverse direction. Two opposite sides of the fastening portion are bent frontward and extended to from a pair of clamping arms. Tails of the clamping arms form a pair of clamping portions. The positioning lumps are respectively molded around joints of the fastening portion and the clamping arms. The fastening portion of the clamping terminal and the positioning lumps are fixed in the installing slot of the insulating housing. The clamping arms of the clamping terminal are received in the clamping slots of the insulating housing. The clamping portions of the clamping terminal project inward into the inserting chamber of the insulating housing. The filler is integratedly filled in the installing slot of the insulating housing with rears of the clamping part therein.

As described above, the cover is attached on the bottoms of the insulating housing and the mounting lump to prevent the water into the inserting chamber from the terminal grooves. The glue is filled into the installing slot and then is solidified to form the filler to prevent the water into the inserting chamber from the installing slot, it is greatly improve the waterproof effect.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
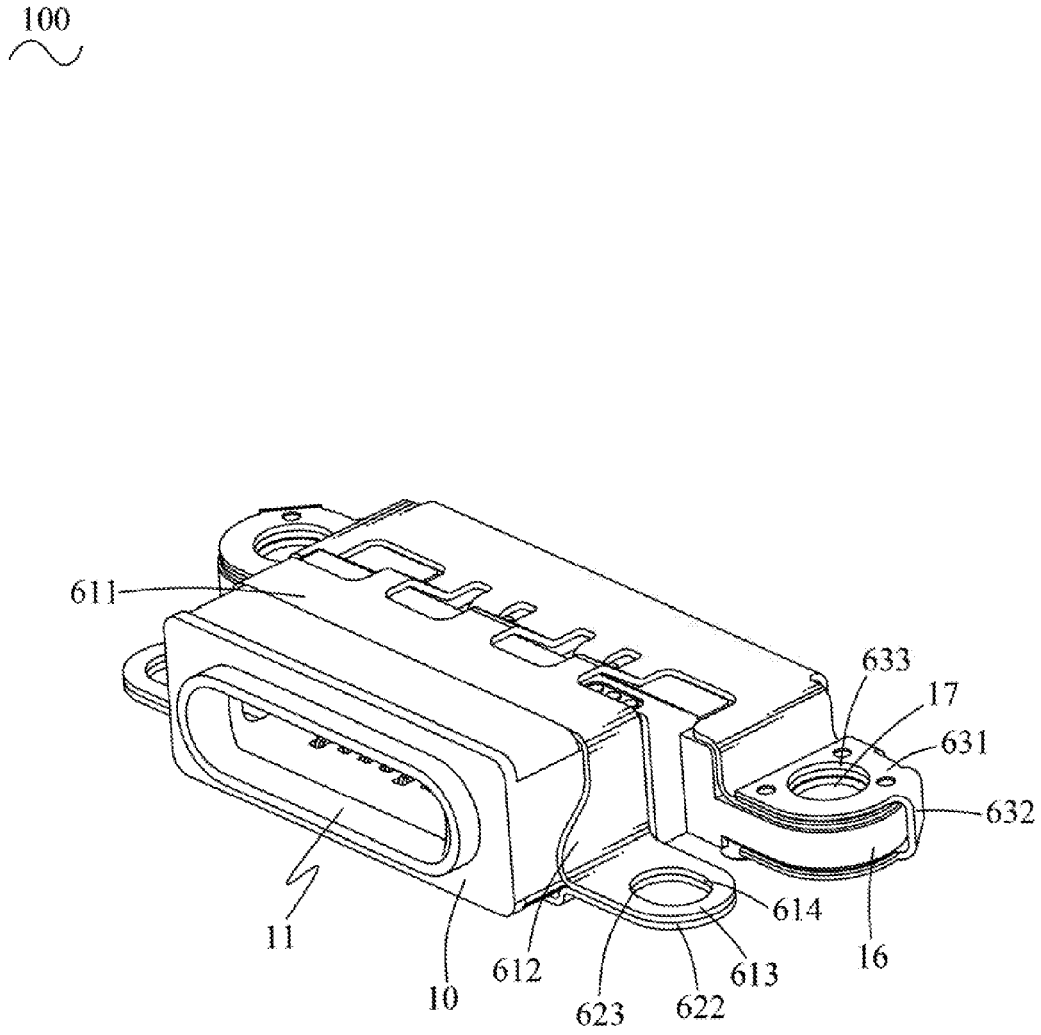
FIG. 1 is a perspective view of a waterproof connector in accordance with an embodiment of the present invention.

With reference to FIGS. 1-6, a waterproof connector 100 in accordance with an embodiment of the present invention is shown. The waterproof connector 100 includes an insulating housing 10, a terminal assembly 20, a cover 30, a clamping part 40, a filler 50 and a group of brackets (not labeled).

Figure 2:
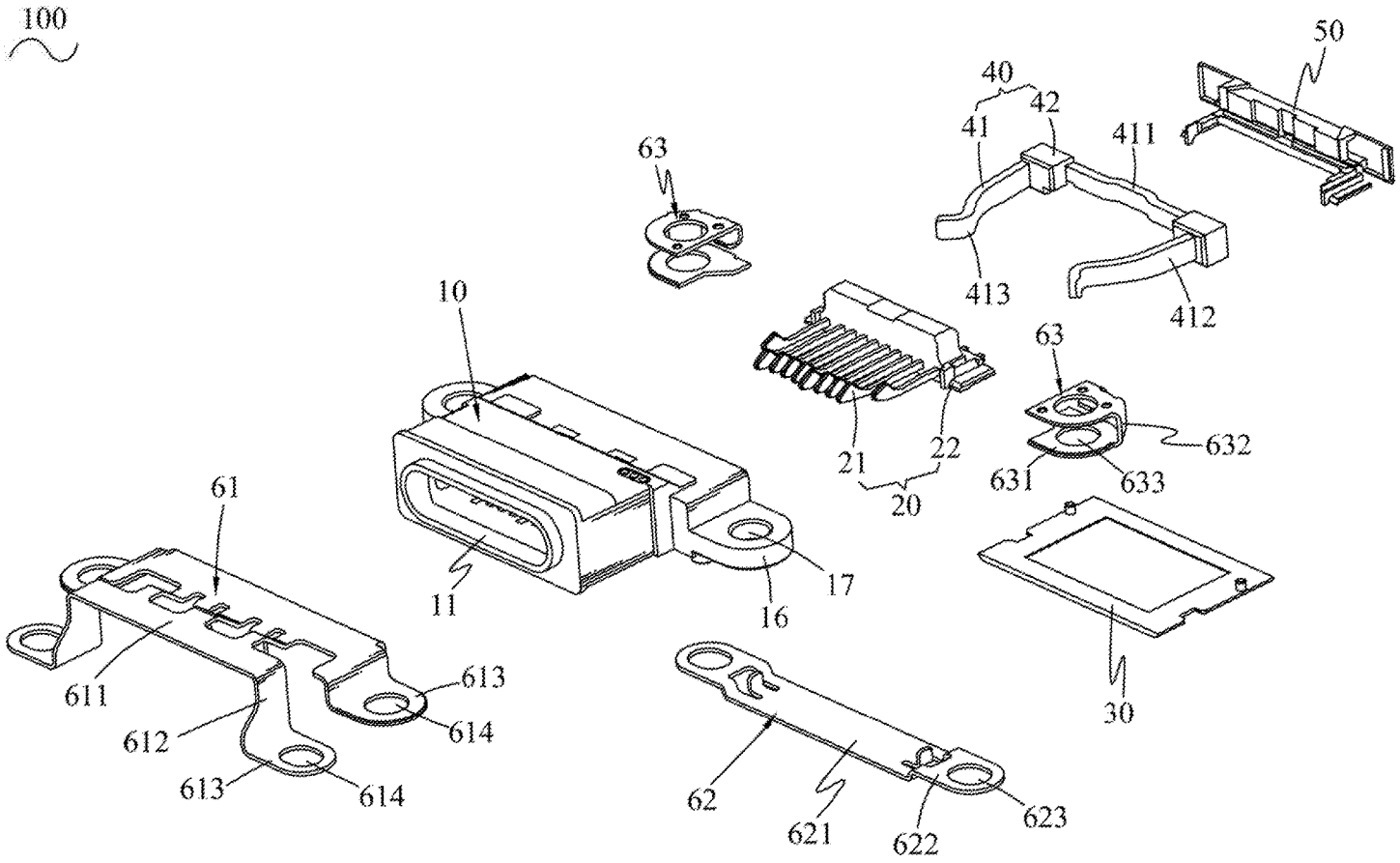
FIG. 2 is an exploded view of the waterproof connector of FIG. 1.
Figure 4:
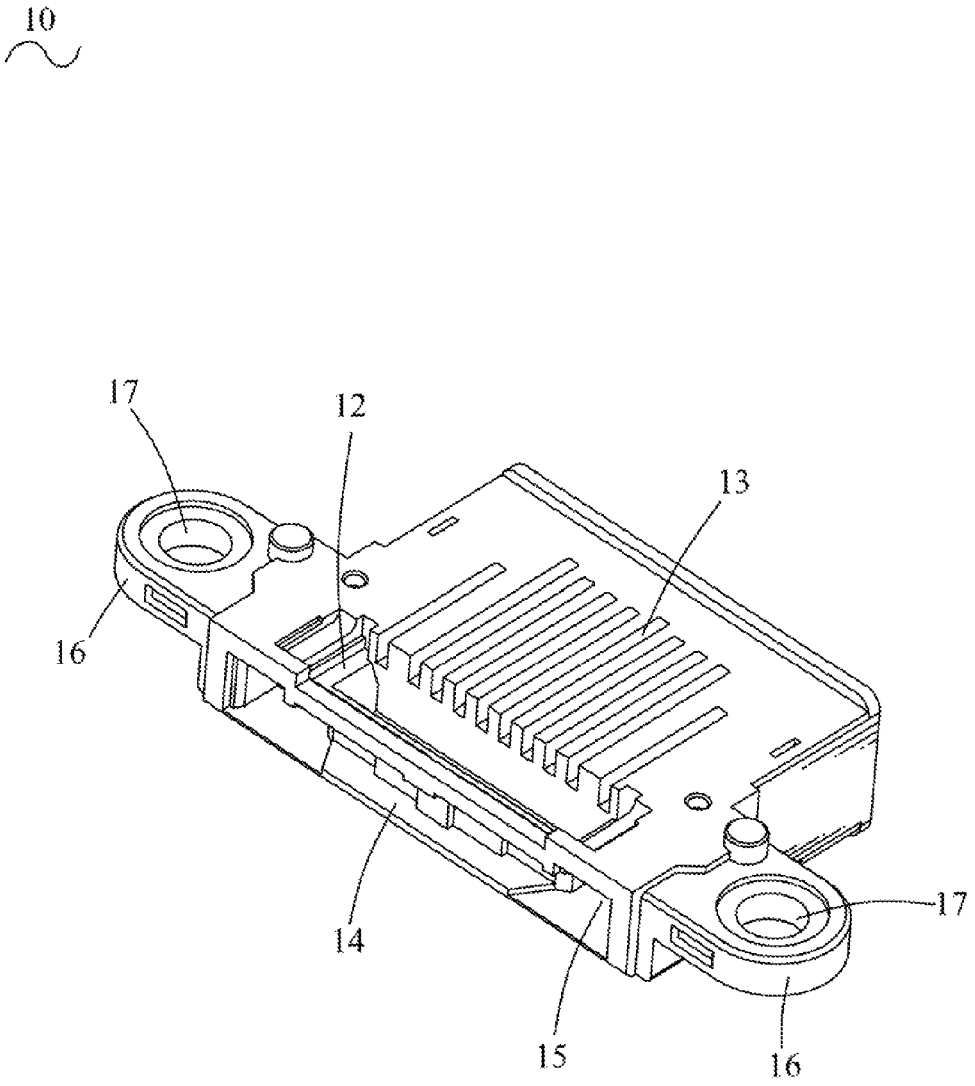
FIG. 4 is a perspective view of an insulating housing of the waterproof connector of FIG. 1.

Referring to FIG. 2 and FIG. 4, the insulating housing 10 is an integrated part. A center of a front face of the insulating housing 10 is concaved rearward to form an inserting chamber 11. A rear of a bottom face of the insulating housing 10 is concaved upward to form a mounting slot 12. The bottom face of the insulating housing 10 further defines a plurality of terminal grooves 13 in front of and connecting with the mounting slot 12. A rear face of the insulating housing 10 is concaved frontward to form an installing slot 14. Two sides of the installing slot 14 are further concaved frontward to form a pair of clamping slots 15 connecting with the inserting chamber 11. Rears of two side faces of the insulating housing 10 respectively protrude outward to form a pair of installing lumps 16. Centers of the installing lumps 16 are opened a pair of installing holes 17 penetrating through the installing lumps 16.

Referring to FIG. 2, the terminal assembly 20 includes a plurality of terminals 21 and a mounting lump 22. The terminals 21 are arranged in transverse direction. The mounting lump 22 is molded on middles of the terminals 21.

Figure 6:
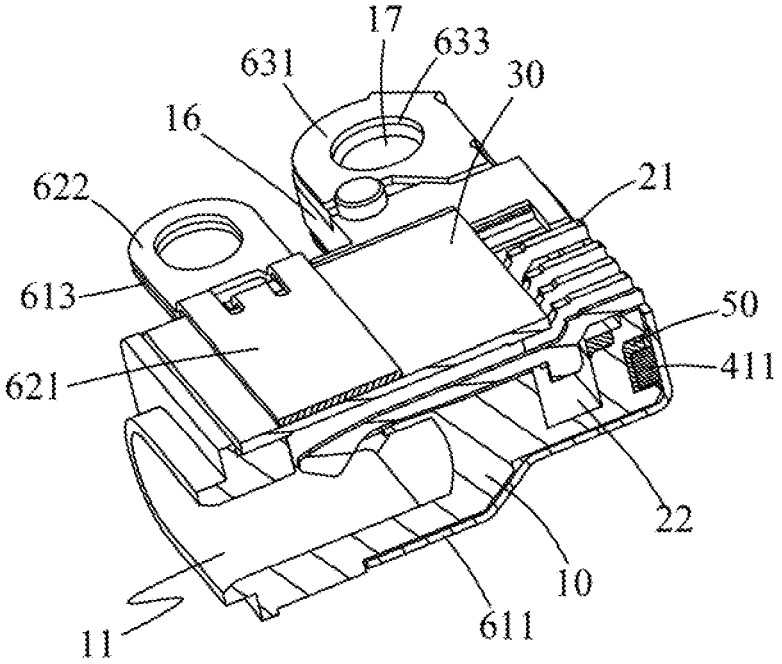
FIG. 6 is another cross-sectional view of the waterproof connector of FIG. 1.

Referring to FIG. 2, FIG. 4 and FIG. 6, the terminal assembly 20 is mounted in the insulating housing 10. In detail, the mounting lump 22 of the terminal assembly 20 is buckled in the mounting slot 12 of the insulating housing 10. Fronts of the terminals 21 are received in the terminal grooves 13 and further projected into the inserting chamber 11. Rears of the terminals 21 are exposed at the bottom face of the insulating housing 10.

Figure 3:
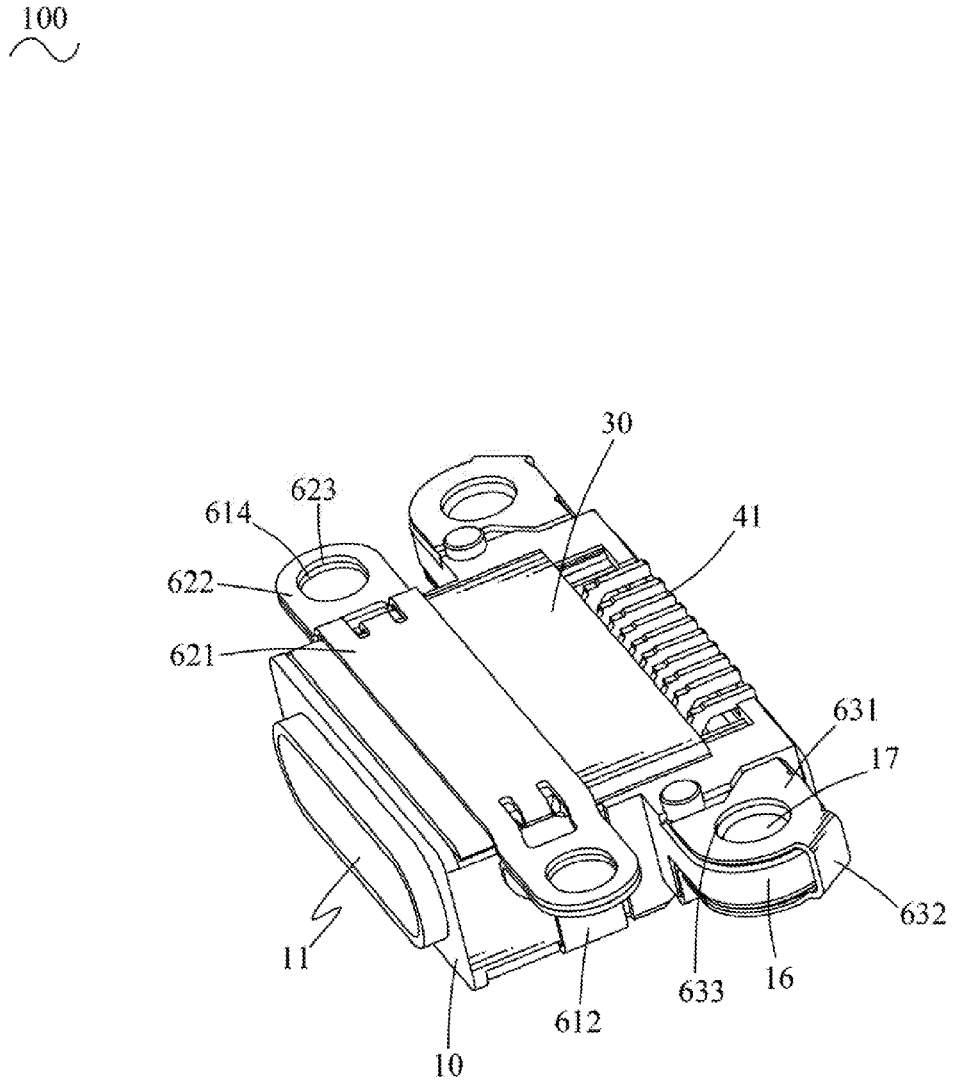
FIG. 3 is another perspective view of the waterproof connector of FIG. 1.

Referring to FIG. 2 and FIG. 3, the cover 30 is located on the bottoms of the insulating housing 10 and the mounting lump 22 to prevent the water into the inserting chamber 11 from the terminal grooves 13.

Referring to FIG. 2, the clamping part 40 includes a U shaped clamping terminal 41 with a frontward opening and a pair of positioning lumps 42. The clamping terminal 41 includes a fastening portion 411 extending in transverse direction. Two opposite sides of the fastening portion 411 are bent frontward and extended to form a pair of clamping arms 412. Tails of the clamping arms 124 are arced inward to form a pair of clamping portions 413. The positioning lumps 42 are respectively molded around joints of the fastening portion 411 and the clamping arms 412.

Figure 5:
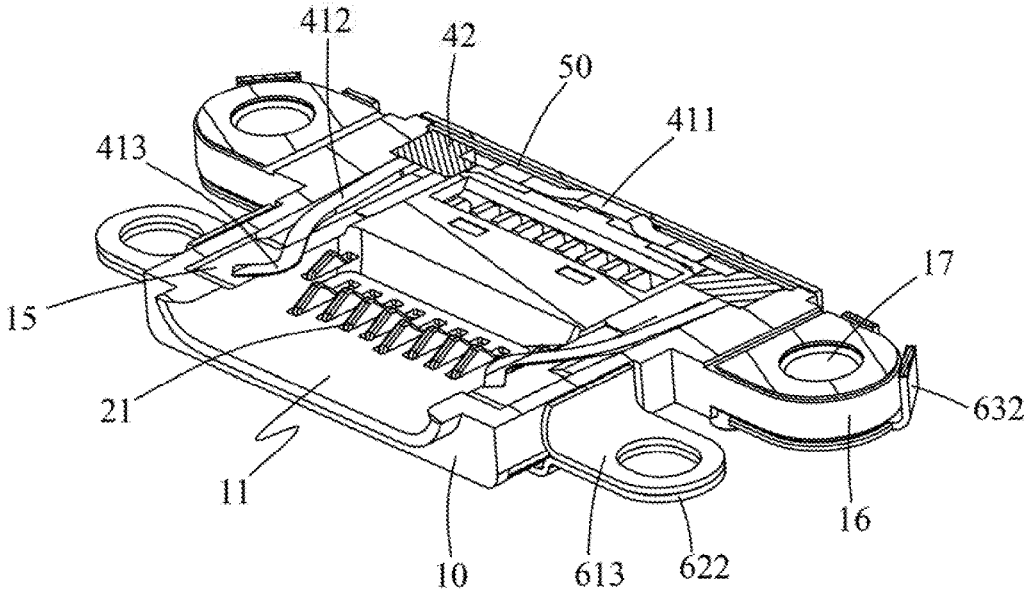
FIG. 5 is a cross-sectional view of the waterproof connector of FIG. 1.

Referring to FIG. 4 and FIG. 5, the clamping part 40 inserts frontward into the insulating housing 10. In detail, the fastening portion 411 of the clamping terminal 41 and the positioning lumps 42 are fixed in the installing slot 14 of the insulating housing 10. The clamping arms 412 of the clamping terminal 41 are received in the clamping slots 15 of the insulating housing 10. The clamping portions 413 of the clamping terminal 41 project inward into the inserting chamber 11 of the insulating housing 10.

Referring to FIG. 2 and FIG. 6, the filler 50 is integrated in the installing slot 14 of the insulating housing 10 with a rear of the clamping part 40 therein. In detail, after inserting the clamping part 40 into the installing slot 14, fill the glue into the installing slot 14 until it is substantially full, and the glue is solidified to form the filler 50. The filler 50 can prevent the water into the inserting chamber 11 from the installing slot 14.

Referring to FIGS. 1-3, the group of brackets includes a top bracket 61, a bottom bracket 62 and a pair of side brackets 63. The top bracket 61 has a top plate 611. Portions of two sides of the top plate 61 is bent downward and extended to form two pair of side plates 612. Tail ends of the side plates 612 are bent outward and extended to form two pair of top fastening plates 613. Each of the top fastening plates 613 is opened a top fastening hole 614. The bottom bracket 62 has a bottom plate 621. Two sides of the bottom plate 621 protrude outward to form a pair of bottom fastening plates 622. Each of the bottom fastening plates 622 is opened a bottom fastening hole 623 corresponding to the top fastening hole 614 of the top bracket 61. Each of the side brackets 63 has two clamping plates 631 paralleled with each other and a connecting plate 632 connecting corresponding portions of the two clamping plates 631. The clamping plates 631 of the side brackets 63 are opened positioning holes 633 corresponding to the installing holes 17 of the insulating housing 10.

The top plate 611 and two side plates 612 of the top bracket 61 respectively are located on the top face and side faces of the insulating housing 10. The bottom plate 621 of the bottom bracket 62 is located on the bottom face of the insulating housing 10 and the cover 30. The top fastening plates 613 of the top bracket 61 and the bottom fastening plates 622 of the bottom bracket 62 project outward beyond the two sides of the insulating housing 10. The top fastening plates 613 of the top bracket 61 are respectively mounted on the bottom fastening plates 622 of the bottom bracket 62 and the installing lumps 16 of the insulating housing 10. The top fastening holes 614 of the top bracket 61 are respectively connected with the bottom fastening holes 623 of the bottom bracket 62 and the installing holes 17 of the insulating housing 10. The side brackets 63 are attached on the installing lumps 16 of the insulating housing 10 respectively. In detail, the clamping plates 631 of the side brackets 63 are respectively attached on the top faces of the corresponding top fastening plates 613 of the top bracket 61 and the bottom faces of the installing lumps 16 of the insulating housing 10. The positioning holes 633 of the side brackets 63 are respectively connected with the corresponding top fastening holes 614 of the top bracket 61 and the installing holes 17 of the insulating housing 10.

As described above, the cover 30 is attached on the bottoms of the insulating housing 10 and the mounting lump 22 to prevent the water into the inserting chamber 11 from the terminal grooves 13. The glue is filled into the installing slot 14 and then is solidified to form the filler 50 to prevent the water into the inserting chamber 11 from the installing slot 14, it is greatly improve the waterproof effect.

What is claimed is:

1. A waterproof connector, comprising:

an insulating housing, a center of a front face of the insulating housing being concaved rearward to form an inserting chamber, a rear of a bottom face of the insulating housing being concaved upward to form a mounting slot, the bottom face of the insulating housing having a plurality of terminal grooves in front of and connecting with the mounting slot, a rear face of the insulating housing being concaved frontward to form an installing slot, two sides of the installing slot being further concaved frontward to form a pair of clamping slots connecting with the inserting chamber;

a terminal assembly including a plurality of terminals and a mounting lump, the terminals being arranged in transverse direction, the mounting lump being molded outside middles of the terminals, the mounting lump of the terminal assembly being mounted in the mounting slot of the insulating housing, fronts of the terminals being received in the terminal grooves and further projected into the inserting chamber, rears of the terminals being exposed at the bottom face of the insulating housing;

a cover attached on the bottom face of the insulating housing and the mounting lump;

a clamping part including a clamping terminal and a pair of positioning lumps, the clamping terminal including a fastening portion extending in transverse direction, two opposite sides of the fastening portion being bent frontward and extended to from a pair of clamping arms, tails of the clamping arms being arced inward to form a pair of clamping portions, the positioning lumps being respectively molded around joints of the fastening portion and the clamping arms, the fastening portion of the clamping terminal and the positioning lumps being fixed in the installing slot of the insulating housing, the clamping arms of the clamping terminal being received in the clamping slots of the insulating housing, the clamping portions of the clamping terminal projecting inward into the inserting chamber of the insulating housing; and a filler integratedly filled in the installing slot of the insulating housing with rears of the clamping part therein.

2. The waterproof connector as claimed in claim 1, further comprising a group of bracket including a top bracket and a bottom bracket, the top bracket having a top plate, portions of two sides of the top plate being bent downward and extended to form a pair of side plates, tail ends of the side plates being bent outward and extended to form a pair of top fastening plates, the bottom bracket having a bottom plate, two sides of the bottom plate protruding outward to form a pair of bottom fastening plates, the top plate and two side plates of the top bracket respectively being attached on a top face and side faces of the insulating housing, the bottom plate of the bottom bracket being attached on the bottom face of the insulating housing and the cover, the top fastening plates of the top bracket and the bottom fastening plates of the bottom bracket projecting outward beyond the insulating housing and engaging with each other.

3. The waterproof connector as claimed in claim 2, wherein each of the top fastening plates is opened a top fastening hole, each of the bottom fastening plates is opened a bottom fastening hole corresponding to the top fastening hole of the top bracket, the top fastening holes of the top bracket are respectively connected with the bottom fastening holes of the bottom bracket.

4. The waterproof connector as claimed in claim 1, further comprising a pair of side brackets, each of the side brackets having two clamping plates paralleling with each other and a connecting plate connecting the two clamping plates, the clamping plates defines positioning holes, rears of the two side faces of the insulating housing respectively protruding outward to form a pair of installing lumps with installing holes formed thereon, the clamping plates locating the corresponding installing lump therebetween with the installing holes and the corresponding installing holes aligned with each other.

* * * * *